US011054133B2

(12) United States Patent
Huang et al.

(10) Patent No.: US 11,054,133 B2
(45) Date of Patent: Jul. 6, 2021

(54) COMBUSTION DEVICE

(71) Applicant: GRAND MATE CO., LTD., Taichung (TW)

(72) Inventors: Chung-Chin Huang, Taichung (TW); Chin-Ying Huang, Taichung (TW); Hsin-Ming Huang, Taichung (TW); Hsing-Hsiung Huang, Taichung (TW); Yen-Jen Yeh, Taichung (TW); Kuan-Chou Lin, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 253 days.

(21) Appl. No.: 16/201,631

(22) Filed: Nov. 27, 2018

(65) Prior Publication Data

US 2020/0011524 A1 Jan. 9, 2020

(30) Foreign Application Priority Data

Jul. 3, 2018 (TW) ..... 107123007

(51) Int. Cl.
*F23D 14/14* (2006.01)
*F23D 14/28* (2006.01)
*F23D 23/00* (2006.01)

(52) U.S. Cl.
CPC ..... *F23D 14/145* (2013.01); *F23D 14/28* (2013.01); *F23D 23/00* (2013.01); *F23D 2203/102* (2013.01); *F23D 2900/14123* (2013.01)

(58) Field of Classification Search
CPC ..... F23D 14/145; F23D 14/14; F23D 14/12; F23D 14/125
See application file for complete search history.

(56) References Cited

U.S. PATENT DOCUMENTS 3,040,805 A * 6/1962 Lambert ..... A21B 2/00 431/329
3,084,736 A * 4/1963 Mentel ..... F23D 14/145 431/329

(Continued)

FOREIGN PATENT DOCUMENTS

CN 103776067 A 5/2014
CN 107091476 A 8/2017

(Continued)

OTHER PUBLICATIONS

European Search Report for EP19183790.5, dated Sep. 30, 2019, Total of 5 pages.

(Continued)

*Primary Examiner* — Avinash A Savani
*Assistant Examiner* — Deepak A Deean
(74) *Attorney, Agent, or Firm* — Tracy M Heims; Apex Juris, pllc.

(57) ABSTRACT

A combustion device includes a first cover, a second cover, an infrared generating mesh, and a gas burner assembly, wherein the first cover has a plurality of through holes. A first half portion of the second cover has at least one hollow portion. A second half portion of the second cover is closed. The infrared generating mesh is disposed between the first cover and the second cover. A flame outlet of the gas burner assembly is located within a projection area of the second half portion. In this way, the intensity of the infrared rays generated by the combustion device could be increased and could be uniform.

8 Claims, 7 Drawing Sheets

(56) References Cited

U.S. PATENT DOCUMENTS

| | | | | | |
|---|---|---|---|---|---|
| 3,122,197 | A * | 2/1964 | Saponara | F23D 14/145 | 431/329 |
| 3,129,749 | A * | 4/1964 | Honger | F23C 99/00 | 431/329 |
| 3,303,869 | A * | 2/1967 | Motoo | F23D 14/145 | 431/329 |
| 3,310,098 | A * | 3/1967 | Hardison | F23D 14/18 | 431/329 |
| 3,330,267 | A | 7/1967 | Bauer | | |
| 3,814,573 | A * | 6/1974 | Karlovetz | F23D 14/145 | 431/329 |
| 3,847,536 | A * | 11/1974 | Lepage | F23D 14/14 | 431/329 |
| 3,857,670 | A * | 12/1974 | Karlovetz | D06F 67/02 | 431/329 |
| 4,927,355 | A * | 5/1990 | Haire | F23D 14/145 | 431/329 |
| 5,326,257 | A * | 7/1994 | Taylor | F23D 14/14 | 431/329 |
| 5,520,536 | A * | 5/1996 | Rodgers | F23D 14/02 | 126/116 R |
| 5,989,013 | A * | 11/1999 | Gray | F23D 14/14 | 126/92 AC |
| 9,752,775 | B2 * | 9/2017 | Embury | F23D 14/465 | |
| 2006/0003279 | A1 * | 1/2006 | Best | F23D 14/14 | 431/328 |
| 2009/0239187 | A1 | 9/2009 | Johnston | | |
| 2014/0242529 | A1 | 8/2014 | Arnold, III | | |
| 2015/0184850 | A1 * | 7/2015 | Seeley | F23D 14/16 | 431/5 |

FOREIGN PATENT DOCUMENTS

| | | | |
|---|---|---|---|
| CN | 206861688 | U | 1/2018 |
| JP | 2003235436 | A | 8/2003 |
| KR | 20070046048 | A | 5/2007 |
| KR | 20120080707 | A | 7/2012 |
| KR | 101689089 | B1 | 12/2016 |
| TW | M543657 | U | 6/2017 |
| TW | I622738 | B | 5/2018 |

OTHER PUBLICATIONS

English Abstract for TWM543657, Total of 1 page.
Chinese search report for CN201810750694.9, dated Aug. 28, 2020, Total of 2 pages.
English abstract for CN103776067, Total of 1 page.
English abstract for CN107091476, Total of 1 page.
English abstract for CN206861688, Total of 1 page.
English abstract for JP2003235436, Total of 1 page.
English abstract for KR101689089, Total of 1 page.
English abstract for KR20070046048, Total of 1 page.
English abstract for KR20120080707, Total of 1 page.
English abstract for TWI622738, Total of 1 page.

* cited by examiner

COMBUSTION DEVICE

BACKGROUND OF THE INVENTION

Technical Field

The present invention relates generally to a gas burner, and more particularly to a combustion device capable of producing open fires and infrared rays.

Description of Related Art

Generally speaking, gas combustion devices are adapted to burn gas to generate flame for heating an object. When using gas combustion devices to heat an object, heat is conducted from a surface of the object to an inside of the object, such that the surface is heated greater while the interior gets less heat, resulting in the object not being heated uniformly.

To resolve the aforementioned problem, there is a known infrared ray heat source device as disclosed in Taiwan Utility Model patent M543657, which is characterized by penetrating objects with infrared rays and heating the surface as well as the interior simultaneously. At the patent, a mesh structure 1 and a guiding plate 2 form a gas returning space, so that gas is guided by a guiding surface 21 of the guiding plate 2 to form a recirculation gas, and gas enters a hole of the mesh structure 1 in a tangential direction of a first surface 11 of the mesh structure 1, and then gas penetrates a second surface 12, whereby the mesh structure 1 generates infrared rays.

However, the guiding plate 2 of the aforementioned patent is closed, so that in fact, gas cannot be returned to the first surface 11 of the mesh structure 1 along the guiding surface 21 of the guiding plate 2 as described in that patent. The reason is that after gas being outputted from a gas ejecting device 3, gas will form a back pressure between the mesh structure 1 and the guiding plate 2, and the back pressure will affect the flow of the gas so that the gas cannot return to the first surface 11 of the mesh structure 1 along the guiding surface 21, thereby most of the flame will concentrate on an area of the mesh structure 1 which is closer to the gas ejecting device 3, and cannot extend to a higher portion, resulting in uneven heating of the mesh structure 1, affecting the uniformity of the generated infrared rays.

In all aspects, the conventional infrared ray heat source device still has room for improvements.

BRIEF SUMMARY OF THE INVENTION

In view of the above, the primary objective of the present invention is to provide a combustion device, which could allow the generated infrared rays to diverge evenly.

In addition, the another primary objective of the present invention is to provide a combustion device, which could enhance the intensity of the generated infrared rays.

The present invention provides a combustion device, which includes a first cover, a second cover, an infrared generating mesh, and a gas burner assembly, wherein the first cover has a first outer surface and a first inner surface which face opposite directions. A plurality of through holes penetrating through the first outer surface and the first inner surface are disposed on the first cover. The second cover has a second outer surface and a second inner surface which face opposite directions, wherein the second cover is disposed on the first cover. A chamber is formed between the second inner surface and the first inner surface. The second cover is divided into a first half portion and a second half portion. At least one hollow portion penetrating through the second outer surface and the second inner surface is disposed on the first half portion. The second half portion is closed. The infrared generating mesh is disposed between the first cover and the second cover and located in the chamber, wherein the infrared generating mesh is heated by a flame to generate infrared rays, and the generated infrared rays emit through the through holes. The gas burner assembly has a flame outlet for burning gas to generate the flame to act on the infrared generating mesh, wherein the flame outlet is located within a projection area of the second half portion.

By disposing the hollow portions on the first half portion of the second cover, the problem that the combustion device is unevenly burned due to a back pressure which causes unevenness of the emitted infrared rays could be solved. In addition, with the infrared ray generating net in the chamber, the intensity of the generated infrared rays could be effectively enhanced.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
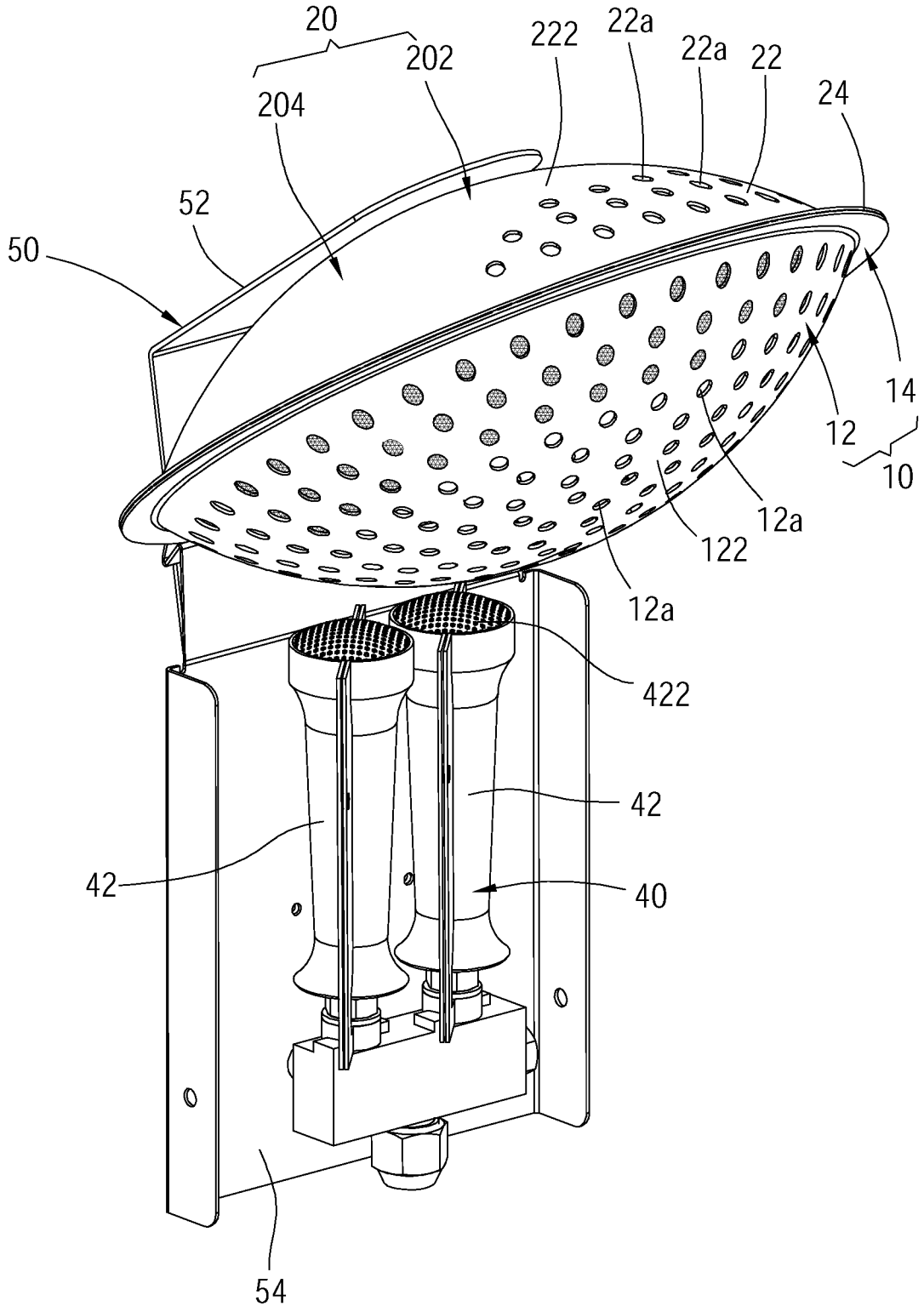
FIG. 1 is a perspective view of the combustion device of an embodiment according to the present invention.
Figure 2:
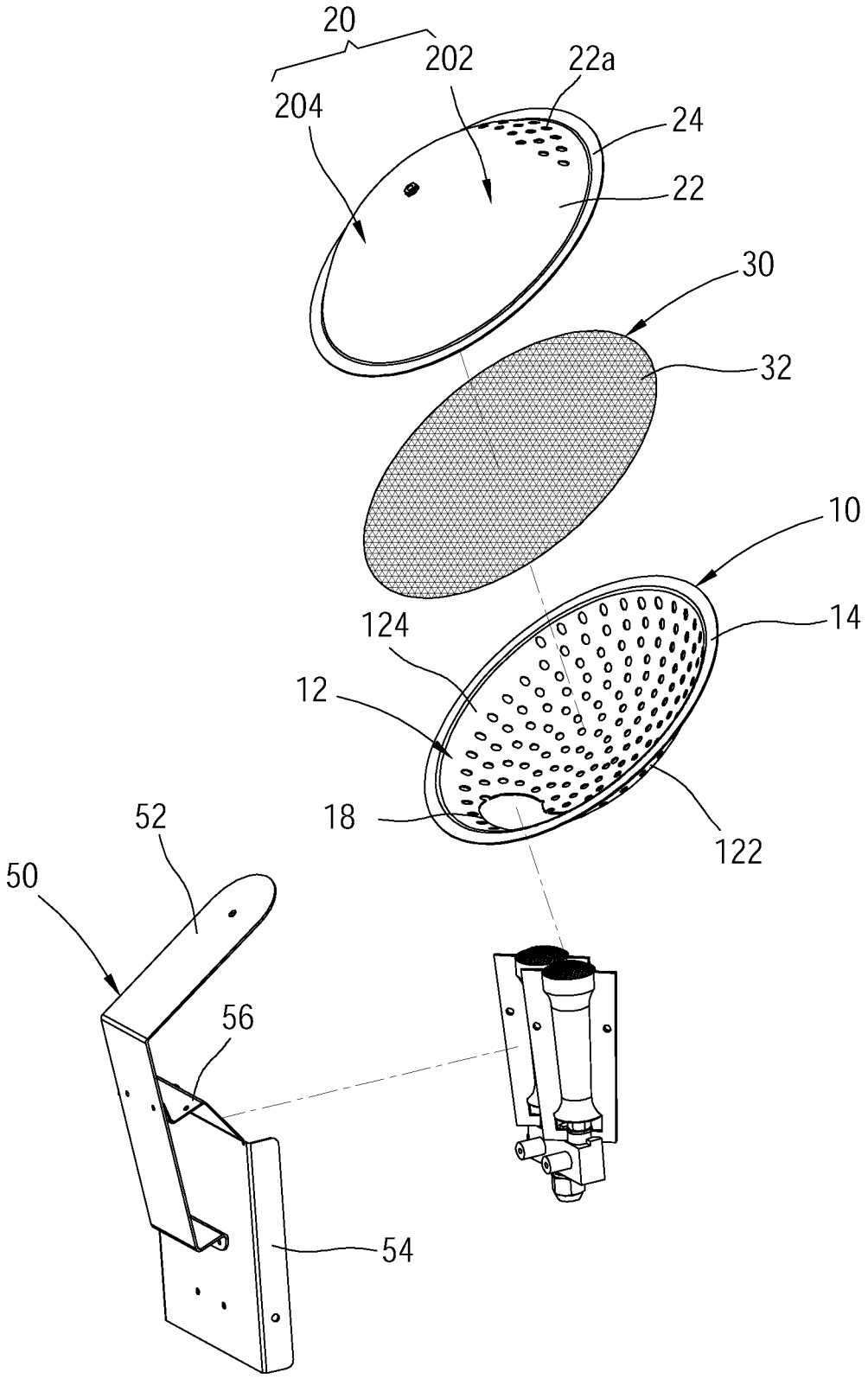
FIG. 2 is an exploded perspective view of FIG. 1.
Figure 3:
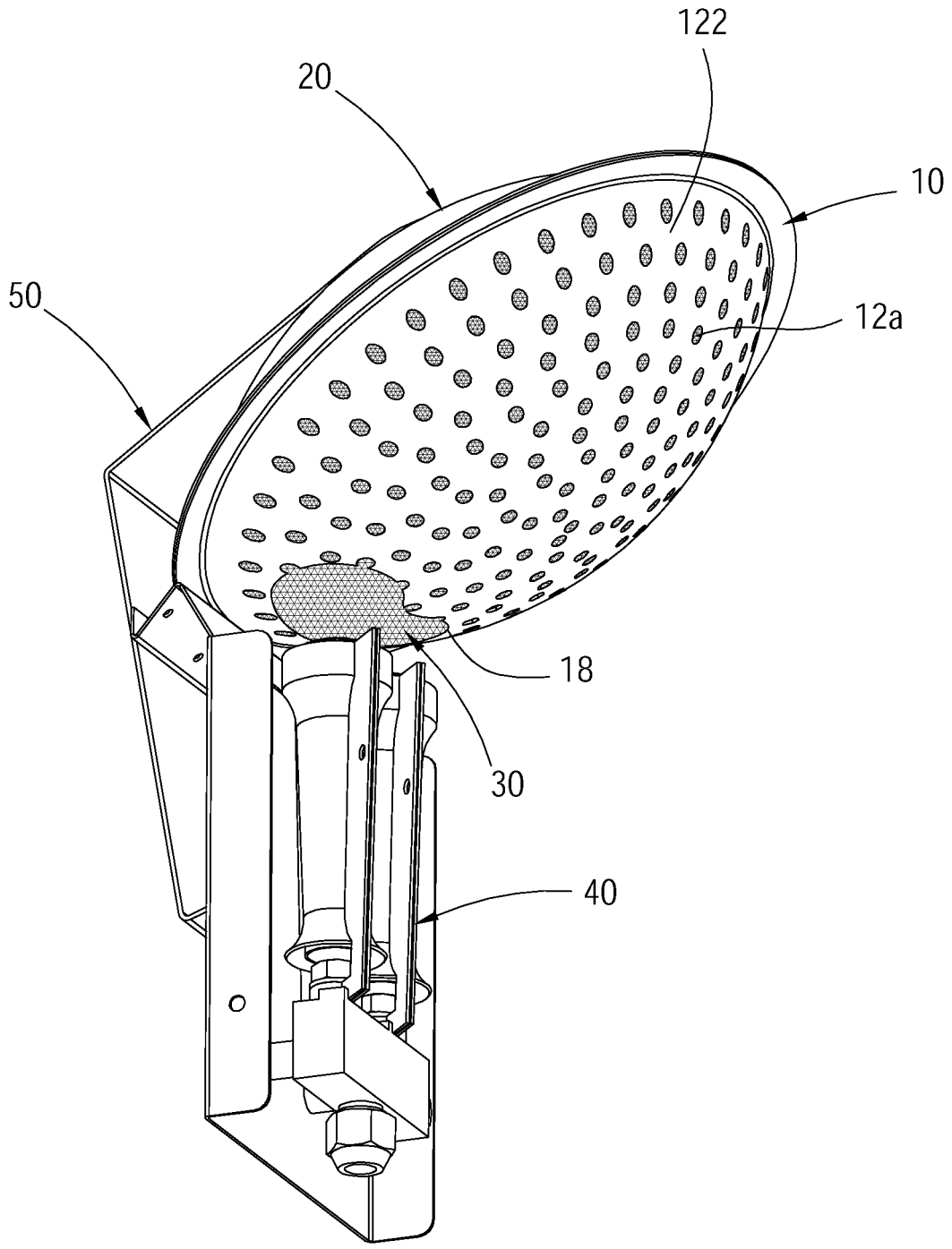
FIG. 3 is a perspective view of the combustion device of the embodiment according to the present invention seen from another perspective.
Figure 4:
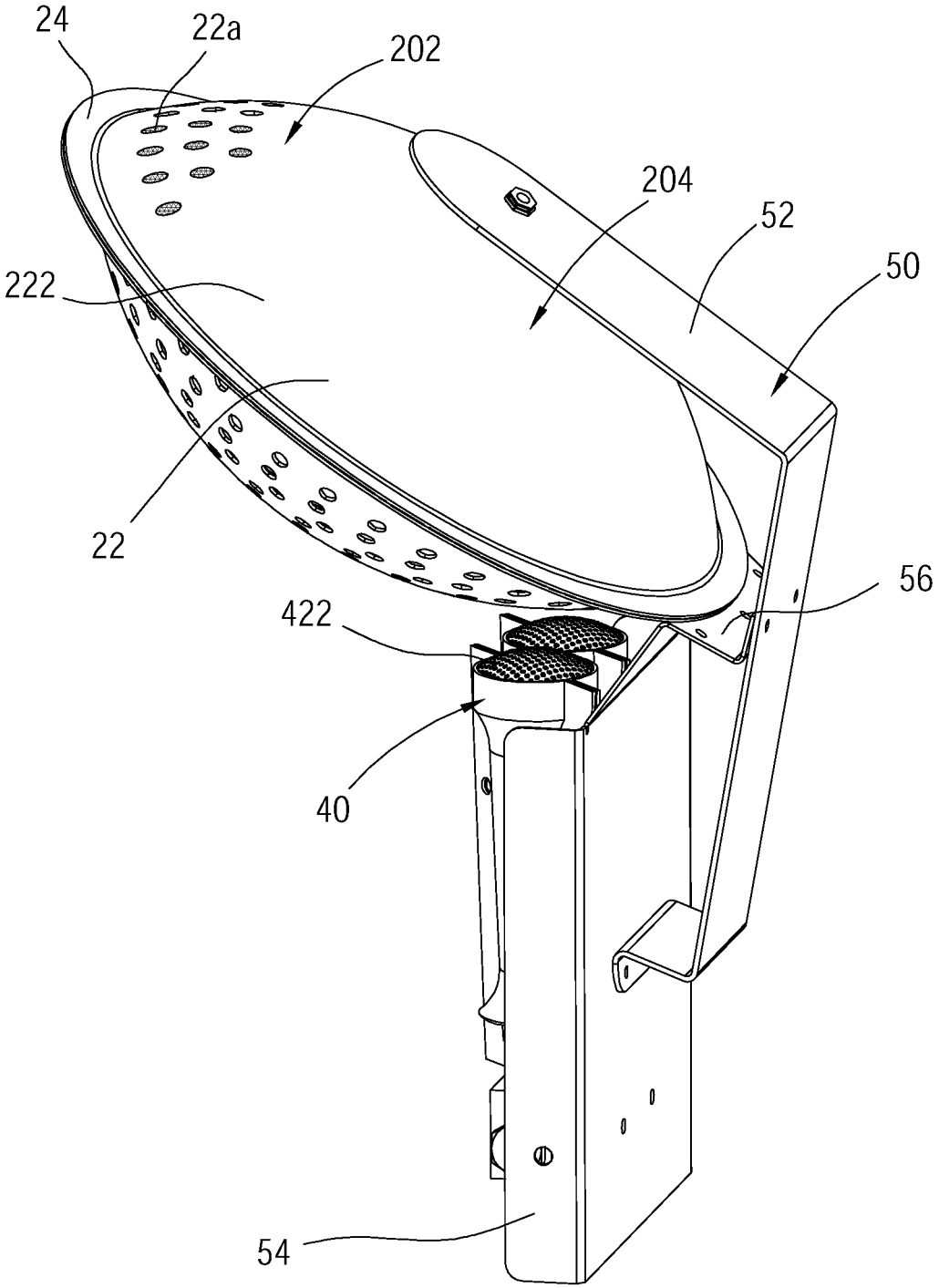
FIG. 4 is a perspective view of the combustion device of the embodiment according to the present invention seen from another perspective.

A combustion device of an embodiment according to the present invention is illustrated in FIG. 1 to FIG. 7 and includes a first cover 10, a second cover 20, an infrared generating mesh 30, and a gas burner assembly 40.

The first cover 10 is made of metal and includes a first body portion 12 and a first peripheral portion 14, wherein the first body portion 12 has a first outer surface 122 and a first inner surface 124 which face opposite directions. The first inner surface 124 is recessed toward the first outer surface 122 to be concave in shape. A plurality of through holes 12*a* penetrating through the first outer surface 122 and the first inner surface 124 are disposed on the first body portion 12. The first peripheral portion 14 is annular and extends outward from a periphery of the first body portion 12. The first cover 10 is disposed to be incline. An opening 18 penetrating through the first outer surface 122 and the first inner surface 124 is disposed on a lower position of the first body portion 12. In practice, the first body portion 12 is not limited to be concave in shape, but could be a rectangle with through holes or other shapes with through holes.

The second cover 20 is made of metal and includes a second body portion 22 and a second peripheral portion 24, wherein the second body portion 22 has a second outer surface 222 and a second inner surface 224 which face opposite directions. The second inner surface 224 is recessed toward the second outer surface 222 to be concave in shape and faces the first inner surface 124 of the first cover 10. The second peripheral portion 24 is annular and extends outward from a periphery of the second body portion 22. The second cover 20 is disposed on the first cover 10, and a chamber S is formed between the second inner surface 224 and the first inner surface 124. More specifically, the first cover 10 is fixed to the second cover 20 by engaging the second peripheral portion 24 and the first peripheral portion 14. The second cover 20 is divided into a first half portion 202 and a second half portion 204, wherein at least one hollow portion 22*a* penetrating through the second outer surface 222 and the second inner surface 224 is disposed on the second body portion 22 within the first half portion 202, and the second half portion 204 is closed. The second cover 20 is inclined downward from the first half portion 202 toward the second half portion 204. In the current embodiment, there are a plurality of hollow portions 22*a* being disposed, and the hollow portions 22*a* are holes.

Figure 5:
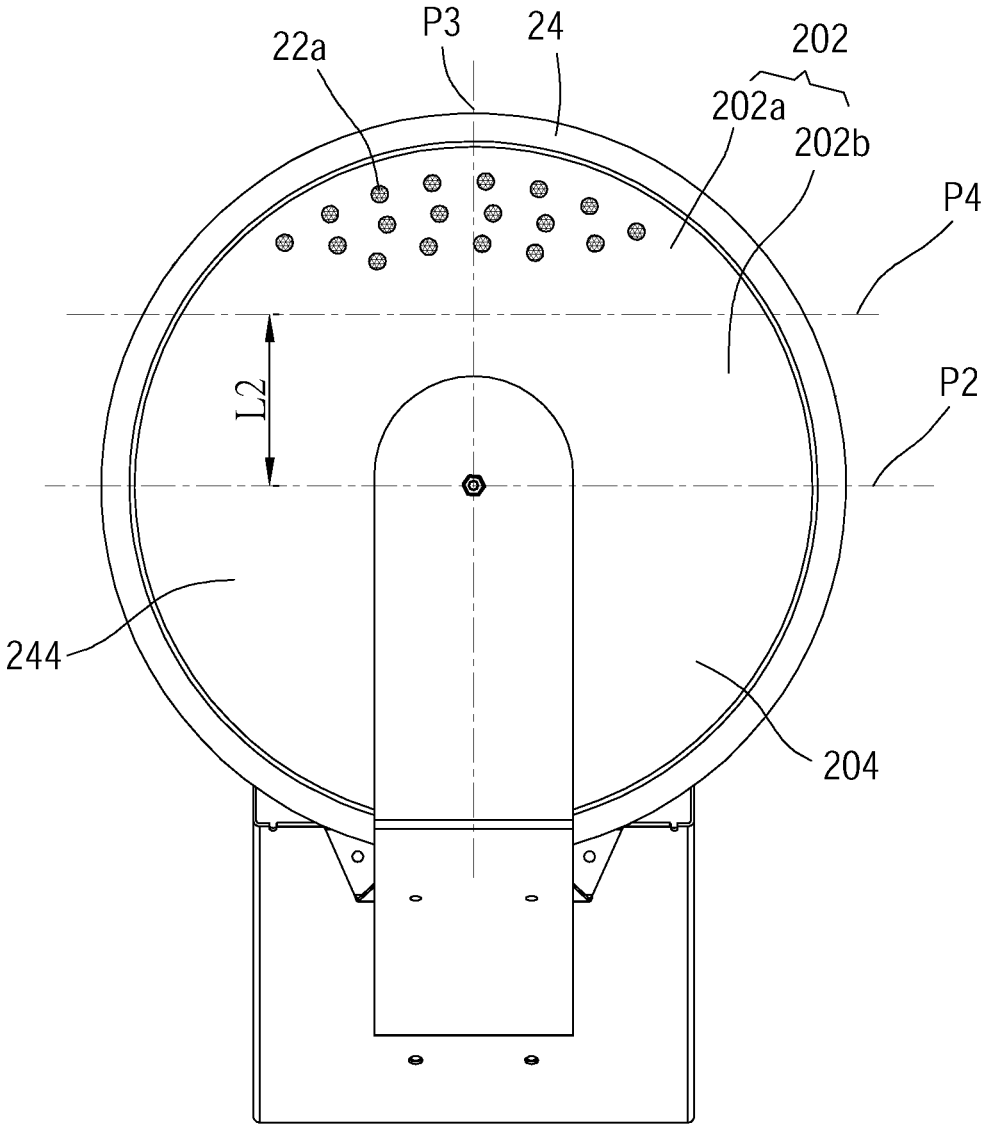
FIG. 5 is a top view of the second cover of the combustion device of the embodiment according to the present invention.
Figure 6:
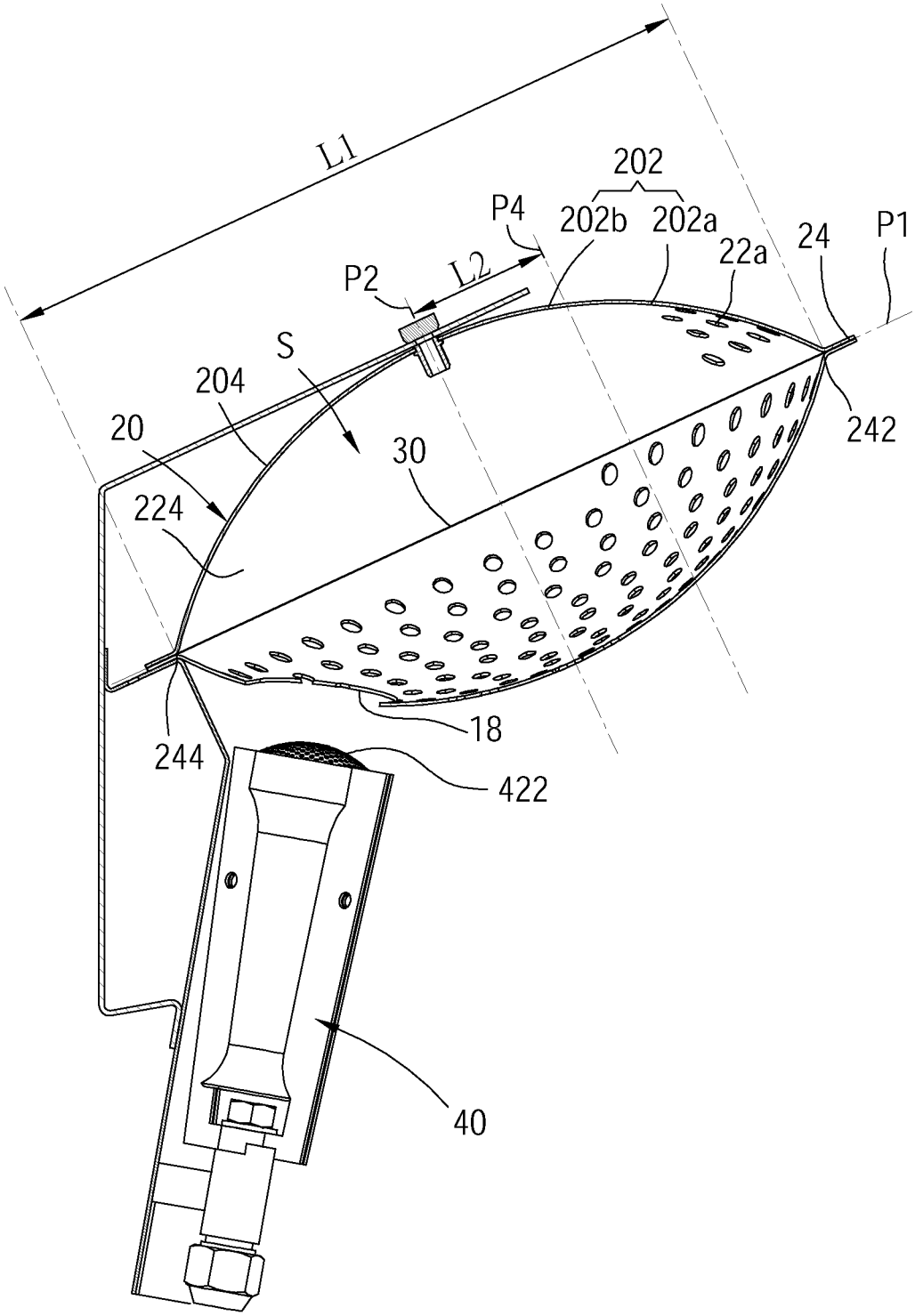
FIG. 6 is a partially sectional view of the combustion device of the embodiment according to the present invention along the third reference plane.

As shown in FIG. 5 and FIG. 6, in the current embodiment, the second peripheral portion 24 is located on a first reference plane P1, wherein a second reference plane P2 is defined on the first reference plane P1, and passes through a center of the first reference plane P1, and is perpendicular to the first reference plane P1. The second cover 20 is divided into the first half portion 202 and the second half portion 204 by the second reference plane P2. A third reference plane P3 is defined on the first reference plane P1, and passes through the center of the first reference plane P1, and is perpendicular to the first reference plane P1 and the second reference plane P2. That is, an intersection of the first reference plane P1, the second reference plane P2, and the third reference plane P3 is a center of the second cover 20. The second peripheral portion 24 has two opposite inner edges 242, 244 on the third reference plane P3, wherein the inner edges 242, 244 are spaced by a first distance L1. A fourth reference plane P4 is defined on the first reference plane P1, and is parallel to the second reference plane P2, and is perpendicular to the third reference plane P3, and passes through the first half portion 202. The fourth reference plane P4 is apart from the second reference plane P2 by a second distance L2, wherein the second distance L2 is a quarter of the first distance L1. In other words, the fourth reference plane P4 is located halfway between one of the inner edges (i.e., the inner edge 242) and the second reference plane P2. The first half portion 202 of the second cover 20 is divided into a first sub-portion 202*a* and a second sub-portion 202*b* by the fourth reference plane P4. Preferably, the hollow portions 22*a* are located at the first sub-portion 202*a*, and the second sub-portion 202*b* is closed. The number of hollow portions 22*a* gradually increases in a direction away from the second half portion 204 and the fourth reference plane P4. In other words, the closer to the second peripheral portion 24, the greater the number of the hollow portions 22*a*.

The infrared generating mesh 30 is disposed between the first cover 10 and the second cover 20 and is located in the chamber S. The infrared generating mesh 30 is heated by a flame to generate infrared rays, and the generated infrared rays emit through the through holes 12*a* of the first cover 10. In the current embodiment, the infrared generating mesh 30 has a third peripheral portion 32 disposed between the first peripheral portion 14 and the second peripheral portion 24, thereby to fix the infrared generating mesh 30 between the first cover 10 and the second cover 20, whereby the infrared generating mesh 30 is located on the first reference plane P1. A mesh density per unit area of the infrared ray generating net 30 is greater than a density of the through holes 12*a* per unit area of the first cover 10. The infrared generating mesh 30 could be made of metal, alloy, ceramic, etc.

The gas burner assembly 40 includes at least one burner 42, wherein the burner 42 has at least one flame outlet 422 for burning gas to generate a flame to act on the infrared generating mesh 30. The flame outlet 422 is located within a projection area of the second half portion 204 of the second cover 20. In the current embodiment, the gas burner assembly 40 includes a plurality of burners 42, and the flame outlet 422 of each of the burners 42 is located below the opening 18 of the first cover 10. The flame generated by the burners 42 acts on the infrared generating mesh 30 via the opening 18. In practice, the burner 42 of the gas burner assembly 40 is not limited to be located below the first cover 10, but could extends into the chamber S, as long as the flame is burned on the infrared generating mesh 30.

In the current embodiment, the combustion device further includes a support 50 for fixing the relative positions of the first cover 10, the second cover 20, and the gas burner assembly 40. The support 50 includes a first supporting plate 52, a second supporting plate 54, and a third supporting plate 56, wherein the third supporting plate 56 is located between the first supporting plate 52 and the second supporting plate 54. The second cover 20 is fixed on the first supporting plate 52 at where a junction of the second reference plane P2 and the third reference plane P3 (i.e., a central position of the second cover 20). The gas burner assembly 40 is fixed on the second supporting plate 54, and at least one of the first peripheral portion 14 and the second peripheral portion 24 is fixed on the third supporting plate 56.

Figure 7:
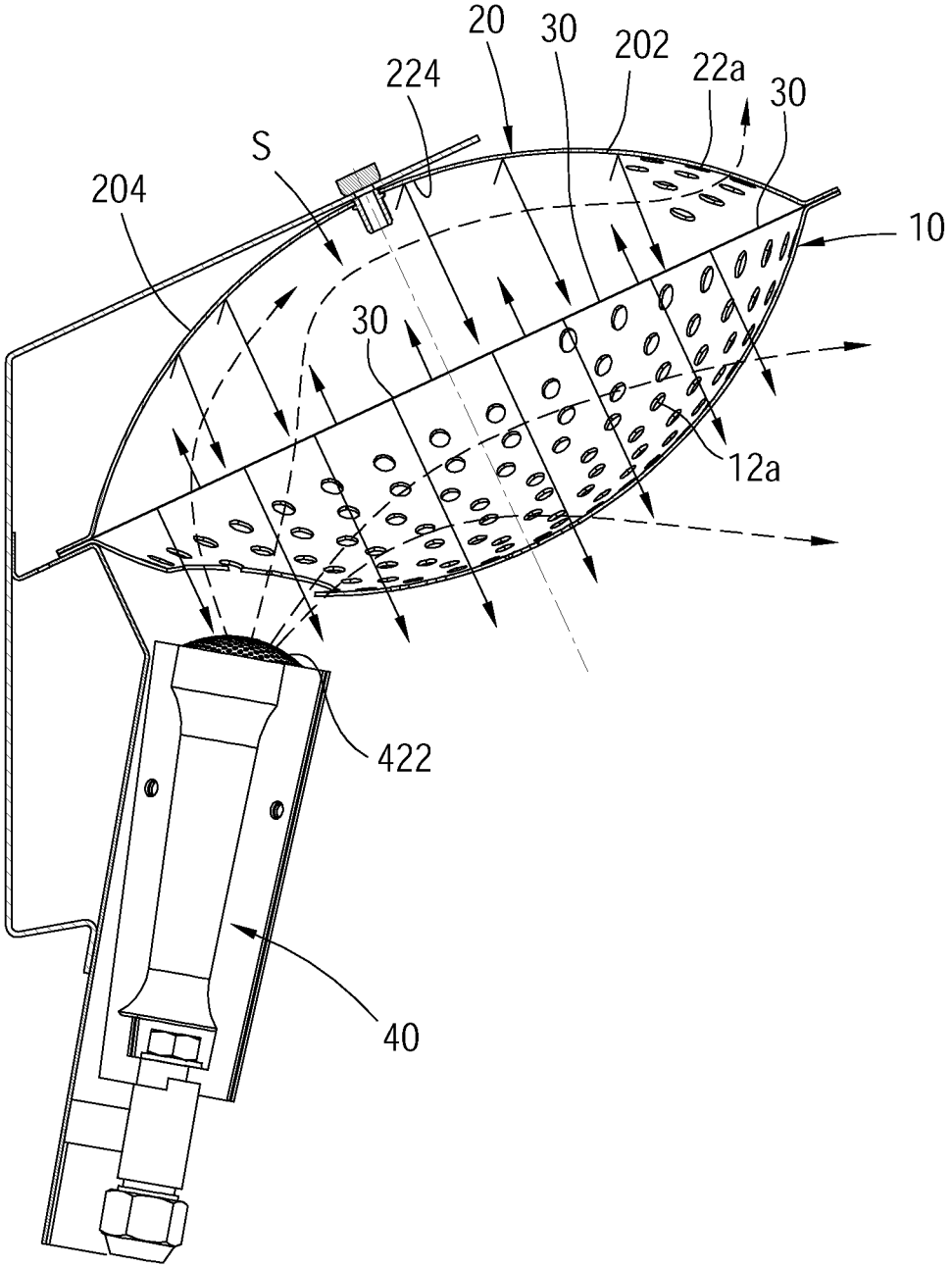
FIG. 7 is a schematic view, showing the flow direction of the gas flow and the direction of the emission of the infrared rays.

As shown in FIG. 7, when the flame generated by the gas (shown by the dotted arrow in FIG. 7) outputted from the flame outlet 422 of the gas burner assembly 40 acts on the infrared generating mesh 30, the infrared generating mesh 30 is heated to emit infrared rays (shown by the solid arrow in FIG. 7), wherein a part of the infrared rays emits outward via the through holes 12*a* of the first cover 10, while another part of the infrared rays emits toward a direction of the second inner surface 224 of the second cover 20. The second inner surface 224 reflects the infrared rays toward a direction of the first cover 10, and the infrared rays emit outward via the through holes 12*a* of the first cover 10, thereby to increase the intensity of the infrared rays emitted by the combustion device. When the first cover 10 is burned by a flame, infrared rays are generated, and the flame passes through the through holes 12*a* to form an open flame.

It is worth mentioning that, since the second half portion 204 of the second cover 20 is closed, and the flame outlet 422 of the gas burner assembly 40 is located within the projection area of the second half portion 204, the flame generated by the gas outputted from the flame outlet 422 flows toward the first half portion 202 along the second inner surface 224 within the second half portion 204. In addition, since the first half portion 202 has the hollow portions 22*a*, a part of the gas and a part of the flame could form an open flame outside of the chamber S along the second inner surface 224 within the first half portion 202, so that gas would not form a back pressure in the chamber S below the first half portion 202 to easily flow in the chamber S. In this way, the flame could uniformly act on the infrared ray generating net 30 and evenly act on the first cover 10, so that the intensity of the infrared rays generated by the combustion device could be increased and could be uniform.

By disposing the hollow portions on the first half portion of the second cover, the problem that the combustion device is unevenly burned due to a back pressure which causes unevenness of the emitted infrared rays could be solved. In addition, with the infrared ray generating net in the chamber, the intensity of the generated infrared rays could be effectively enhanced.

It must be pointed out that the embodiments described above are only some preferred embodiments of the present invention. All equivalent structures which employ the concepts disclosed in this specification and the appended claims should fall within the scope of the present invention.

What is claimed is:

1. A combustion device, comprising:

a first cover having a first outer surface and a first inner surface which face opposite directions, wherein a plurality of through holes penetrating through the first outer surface and the first inner surface are disposed on the first cover;

a second cover having a second outer surface and a second inner surface which face opposite directions, wherein the second cover is disposed on the first cover; a chamber is formed between the second inner surface and the first inner surface; the second cover is divided into a first half portion and a second half portion; at least one hollow portion penetrating through the second outer surface and the second inner surface is disposed on the first half portion; the second half portion is closed and corresponds to a part of the first cover wherein a portion of the plurality of through holes are disposed;

an infrared generating mesh disposed between the first cover and the second cover and located in the chamber, wherein the infrared generating mesh is heated by a flame to generate infrared rays, and the generated infrared rays emit through the plurality of through holes; and a gas burner assembly having a flame outlet for burning gas to generate the flame to act on the infrared generating mesh, wherein the flame outlet is located within a projection area of the second half portion;

wherein the first cover has a first peripheral portion; the second cover has a second peripheral portion; the first peripheral portion is engaged with the second peripheral portion; the second peripheral portion is located on a first reference plane, and a second reference plane is defined on the first reference plane; the second reference plane passes a center of the first reference plane and is perpendicular to the first reference plane; the second cover is divided into the first half portion and the second half portion by the second reference plane; a third reference plane is defined on the first reference plane, wherein the third reference plane passes through the center of the first reference plane and is perpendicular to the first reference plane and the second reference plane; the second peripheral portion of the second cover has two opposite inner edges on the third reference plane; the two opposite inner edges are spaced by a first distance; a fourth reference plane is defined on the first reference plane, wherein the fourth reference plane is parallel to the second reference plane and is perpendicular to the third reference plane and passes through the first half portion; the fourth reference plane is apart from the second reference plane by a second distance; the second distance is a quarter of the first distance; the first half portion of the second cover is divided into a first sub-portion and a second sub-portion by the fourth reference plane; the at least one hollow portion is located at the first sub-portion; the second sub-portion is closed.

2. The combustion device of claim 1, wherein the first cover has a first peripheral portion; the second cover has a second peripheral portion; the infrared generating mesh has a third peripheral portion; the first peripheral portion is engaged with the second peripheral portion, and the third peripheral portion is disposed between the first peripheral portion and the second peripheral portion.

3. The combustion device of claim 2, further comprising a support, wherein the support comprises a first supporting plate, a second supporting plate, and a third supporting plate; the third supporting plate is located between the first supporting plate and the second supporting plate; the second cover is fixed on the first supporting plate; the gas burner assembly is fixed on the second supporting plate; at least one of the first peripheral portion and the second peripheral portion is fixed on the third supporting plate.

4. The combustion device of claim 1, further comprising a support, wherein the support comprises a first supporting plate, a second supporting plate, and a third supporting plate; the third supporting plate is located between the first supporting plate and the second supporting plate; the second cover is fixed on the first supporting plate at a junction of the second reference plane and the third reference plane; the gas burner assembly is fixed on the second supporting plate, and at least one of the first peripheral portion and the second peripheral portion is fixed on the third supporting plate.

5. The combustion device of claim 1, wherein the first half portion comprises a plurality of hollow portions, and the hollow portions are holes; a number of hollow portions gradually increases in a direction away from the fourth reference plane.

6. The combustion device of claim 1, wherein the first half portion comprises a plurality of hollow portions, and the hollow portions are holes; a number of hollow portions gradually increases in a direction away from the second half portion.

7. The combustion device of claim 1, wherein a mesh density per unit area of the infrared ray generating net is greater than a density of the plurality of through holes per unit area of the first cover.

8. The combustion device of claim 1, wherein the second inner surface of the second cover is adapted to reflect the infrared rays generated by the infrared generating mesh toward the first cover.

* * * * *